US006058133A

United States Patent [19]

Bowman et al.

[11] Patent Number: 6,058,133

[45] **Date of Patent: *May 2, 2000**

[54] GRAPHITE ELECTRODES INCORPORATING STRESS-RELIEVING SLOTS

[75] Inventors: Brian Bowman, Westlake, Ohio; Ronald Raymond Welch, Brentwood, Tenn.

[73] Assignee: UCAR Carbon Company Inc., Nashville, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/136,245

[22] Filed: Aug. 19, 1998

[51] Int. Cl.[7] ..... H05B 7/06

[52] U.S. Cl. ..... 373/88; 313/44

[58] Field of Search ..... 373/88, 92, 91, 373/89, 111, 94; 313/332, 44; 429/82

[56] References Cited

U.S. PATENT DOCUMENTS

| | | | |
|---|---|---|---|
| 1,088,296 | 2/1914 | Richards | 313/44 |
| 1,912,560 | 6/1933 | Wiles | 373/88 |
| 2,527,294 | 10/1950 | Bailey | 313/332 |
| 2,603,669 | 7/1952 | Chappell | 373/88 |
| 3,877,992 | 4/1975 | Urry | 429/82 |
| 4,118,592 | 10/1978 | Schieber | 373/88 |
| 5,413,738 | 5/1995 | Lewis et al. . | |
| 5,415,755 | 5/1995 | Wise et al. . | |
| 5,575,582 | 11/1996 | Frastaci et al. . | |
| 5,631,919 | 5/1997 | Intermill et al. . | |

*Primary Examiner*—John A. Jeffery
*Assistant Examiner*—Quang Van
*Attorney, Agent, or Firm*—Delio & Peterson

[57] ABSTRACT

A cylindrical graphite electrode with a consumable end includes one or more slots comprising a discontinuous portion of the carbon which extend along the length of the carbon body through at least a portion of the cross-section substantially to the consumable end. The slot may extend from the surface into the body or the slot may extend within the body below the surface. The slot may be filled with a carbonaceous material different from the carbon of the body. The slot may extend helically along the length and around a portion of the periphery of the body. The slots may be formed prior to or after heat treating of the electrode. As the electrode is exposed to a thermal shock, a crack is initiated in and propagates along the electrode and intersects with the slot, wherein substantial further growth of the crack is arrested at the slot.

5 Claims, 3 Drawing Sheets

Fig. 5
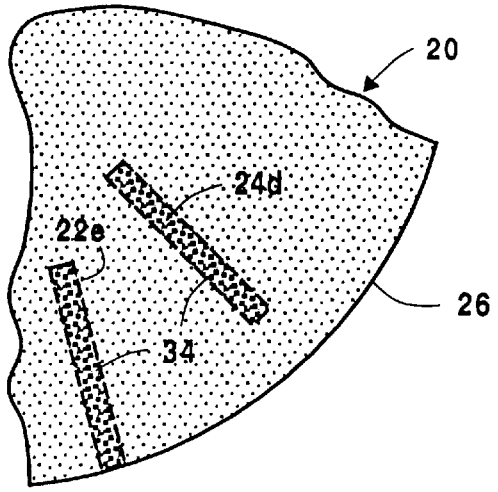
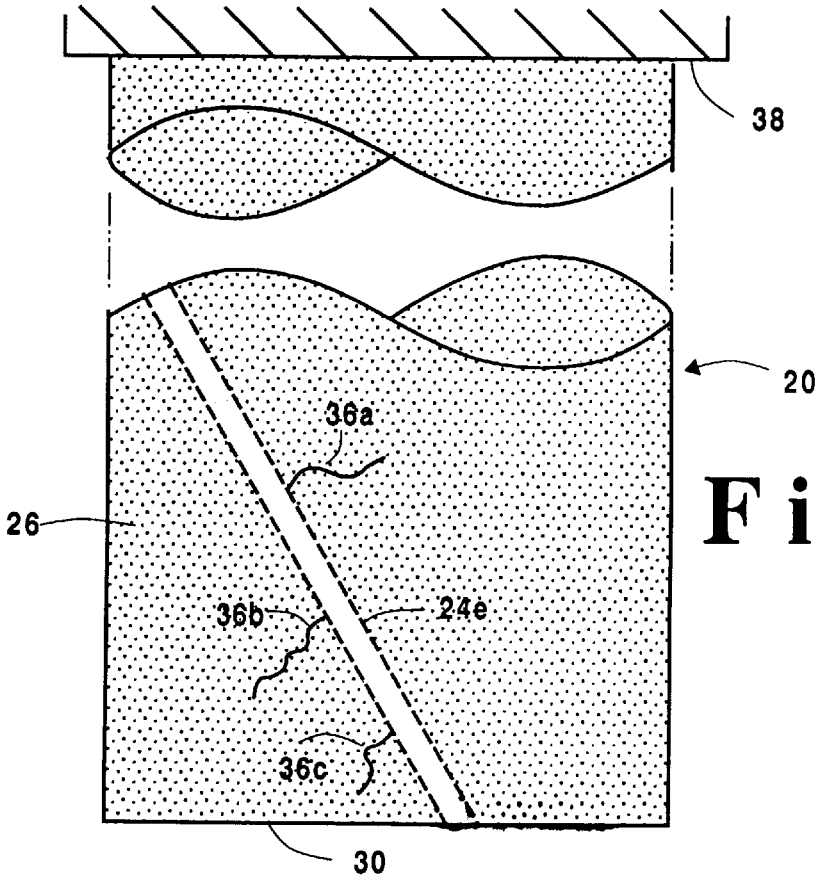
Fig. 6

GRAPHITE ELECTRODES INCORPORATING STRESS-RELIEVING SLOTS

BACKGROUND OF THE INVENTION

1. Field of the Invention

The present invention relates to graphite electrodes and, in particular, to graphite electrodes incorporating stress relieving slots on or below the surface.

2. Description of Related Art

Carbon electrodes, particularly graphite electrodes, are used in such applications as electric arc steelmaking furnaces and other applications in which one end (usually the top) is physically and electrically connected to the furnace and power supply while the other, free end (usually the bottom) is consumed by the arc which is generated during operation to melt the metallic material in the furnace. The temperatures and thermal gradients are quite high in such an operation. As the electrode is being consumed, it is typically lowered into the furnace to maintain the desired gap with the molten metal. The electrode is thus subject to both thermal shock and physical vibration.

It has been found that large diameter graphite electrodes tend to suffer from deep axial splits in service, especially in high current dc furnaces. These cracks can grow and link up in use and lead to pieces of the electrode falling from the column. A discussion of the problems of cracking under thermal shock may be found in the article "Crack Propagation and Thermal Shock Damage in Graphite Discs Heated by Moving Electron Beam" by Shubert et al. (CARBON, vol. 24 no. 1, 1986 Pergamon Press Ltd.).

Efforts to date to overcome the problem of thermal shock crack propagation have generally dealt with attempting to improve the integrity of the carbon/graphite body and surface. However, these approaches do not fully overcome the aforementioned problem, and a long felt need exists to reduce the electrode failure rate due to thermal shock.

Bearing in mind the problems and deficiencies of the prior art, it is therefore an object of the present invention to provide an improved carbon/graphite electrode which has improved resistance to thermal shock.

It is another object of the present invention to provide a method of making a carbon/graphite body which has increased resistance to crack propagation under extreme thermal shock conditions.

A further object of the invention is to provide a method of making such an improved carbon/graphite electrode which is cost effective.

It is yet another object of the present invention to provide such an improved graphite electrode for use in electric arc furnaces, such as those used in steelmaking.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a carbon electrode comprising a carbon body, preferably graphite with a cylindrical configuration, having a length and a cross-section normal to the length. The carbon body has a consumable end. A slot comprising a discontinuous portion of the carbon extends along the length of the carbon body through at least a portion of the cross-section. The slot may extend from the surface into the body or the slot may extend within the body below the surface.

Preferably, the slot extends along the length of the carbon body substantially to the consumable end and is filled with a carbonaceous material different from the carbon of the body. The slot may extend helically along the length and around a portion of the periphery of the body. The carbon body may have threads around an end thereof opposite the consumable end for securing the body in use.

The carbon body is more preferably a cylindrical graphite electrode having two or more slots no greater than about 5 mm in width spaced around the periphery of the electrode.

In another aspect, the present invention relates to a method of making a carbon electrode. The method initially comprises forming a carbon body having a length and a cross-section normal to the length, the body having a consumable end. The carbon body is heat treated and there is formed in the carbon body a slot comprising a discontinuous portion of the carbon extending along the length of the carbon body through at least a portion of the cross-section. The heat treating may be performed prior to or after the forming step.

Preferably, the body is extruded or molded to a cylindrical configuration and heated to a temperature and for a time sufficient to form a graphite electrode. The slot may be extended from the surface into the body or extended within the body below the surface. The method may include the step of filling the slot with a material different from the carbon of the body, preferably a carbonaceous material.

One, two or more slots, preferably no greater than about 5mm in width, may be formed along the length of the carbon body, and the slot may extend helically along the length and around a portion of the periphery of the body.

In a further aspect, the present invention relates to a method of using a carbon electrode. There is first provided a carbon electrode having a carbon body with a length and a cross-section normal to the length and a slot comprising a discontinuous portion of the carbon extending along the length of the carbon body through at least a portion of the cross-section. The electrode is exposed to a thermal shock and a crack is initiated therein. The crack then propagates along the electrode and intersects with the slot, wherein substantial further growth of the crack is arrested at the slot.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 5 is a partial cross-sectional view normal to the length of another embodiment of a graphite electrode having slots both on the surface and below the surface.

FIG. 6 is a side elevational view showing crack arrest at a slot in a graphite electrode made in accordance with the present invention.

DESCRIPTION OF THE PREFERRED EMBODIMENT(S)

Figure 1:
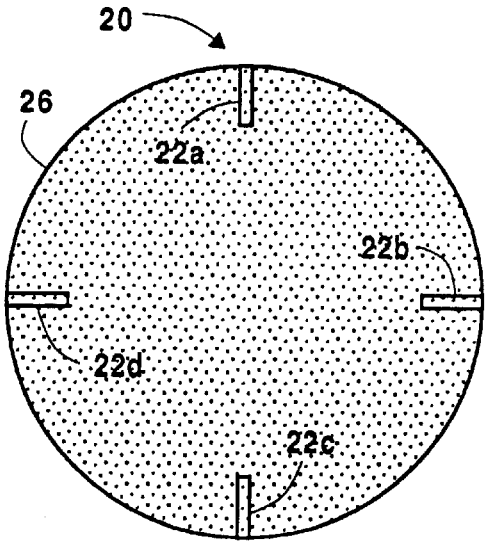
FIG. 1 is a cross-sectional view normal to the length of a first embodiment of a graphite electrode having straight slots in the surface thereof.

In describing the preferred embodiment of the present invention, reference will be made herein to FIGS. 1–6 of the drawings in which like numerals refer to like features of the invention. Features of the invention are not necessarily shown to scale in the drawings.

In accordance with the present invention, it is been unexpectedly found that the formation of one or more slots at and/or below the surface of a carbon body subject to thermal shock, particularly a graphite electrode, serves to significantly reduce the damage from natural splits occurring as a result of the stress intensity generated by thermal gradients in the electrode. Carbon bodies for use as electrodes are well known and are generally made by crushing, sizing and milling calcined petroleum coke and mixing the coke particles with coal-tar pitch binder. The size of the largest particle is generally set by application requirements. For example, if a high resistance to thermal shock is necessary, such as in graphite electrodes, particles up to 25 millimeters may be used to act as stress absorbers in preventing catastrophic failures in the electrode.

After blending the coke filler materials and distributing it in the pitch binder, the carbon body is shaped by extrusion through a die or molded in conventional forming molds. The dies and molds may form the body in substantially its final configuration and size. Subsequently, the shaped and formed carbon product is heat treated by baking to a temperature of 800–1000° C. to convert the thermoplastic pitch binder to solid coke and remove most of the shrinkage in the product associated with pyrolysis of the pitch binder at a slow heating rate. Following baking, impregnation with coal tar or petroleum pitches may be made to deposit additional pitch coke in the open pores of the baked stock. Graphitization is by heat treatment to 3000° C. for a time sufficient to cause the carbon atoms in the petroleum coke filler and pitch coke binder to orient into the graphite lattice configuration. Following such graphitization, additional finishing operations may be performed to shape the final product which is typically made in a cylindrical configuration. For example, threads may be formed in one or both ends of the cylinder to connect to other cylindrical sections to form a longer electrode.

During or after the aforementioned forming and heat treating operations, there may be incorporated slots in and or below the surface of the carbon body in accordance with the present invention. These slots essentially form a discontinuity in the carbon and/or graphite structure which extends along a substantial portion of the length of the carbon body through at least a portion of the cross section normal to the length.

Figure 2:
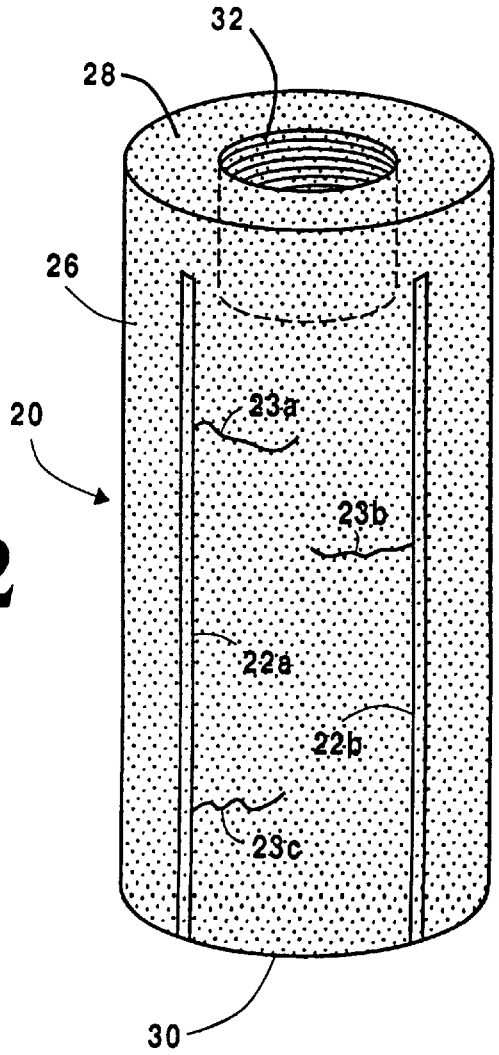
FIG. 2 is a perspective view of the graphite electrode of FIG. 1.

A first embodiment of the present invention is depicted in FIGS. 1 and 2 wherein there is shown a cylindrical graphite electrode 20 having upper and lower ends 28 and 30, respectively, and a cylindrical surface 26 extending around the periphery and along the length of the electrode. A threaded female section 32 is shown at the upper end of the electrode 20 for connection to other electrode sections. Extending along the length of the electrode and open to the surface 26 thereof are a plurality of radially oriented slots 22*a*, 22*b*, 22*c* and 22*d*. Preferably, the slots extend along the majority of the electrode length as shown in FIG. 1, from a point near the upper end 28 down to the lower end 30. The slots extend from the surface of the electrode to a distance below the surface less than the radius of the electrode. Preferably the width of the slots are as thin as practical so as not to reduce the cross section of electrode available for carrying electrical current, for example, from about 1 mm to 3 mm. Preferably, the lower end of the electrode exposed in the furnace, where the electrode column is hot and oxidized, has the slots open to the surface.

Although one and two spaced slots may be utilized, it is more preferred that more than two be utilized, such as three or four slots spaced evenly around the circumference of the electrode. The additional slots reduce potential problems with splits linking up across the electrode diameter. In the case of three slots they would be spaced at 120° intervals around the circumference. In the case of the four slots shown in FIG. 1, they are spaced at 90° intervals around the circumference. In service, the stresses which are generated thermally are insufficient to cause significant further growth of these built in, preformed slots and, as a consequence, the tendency of splits to link up is reduced. Fewer pieces of the electrode are lost and electrode lifetime is increased.

Figure 3:
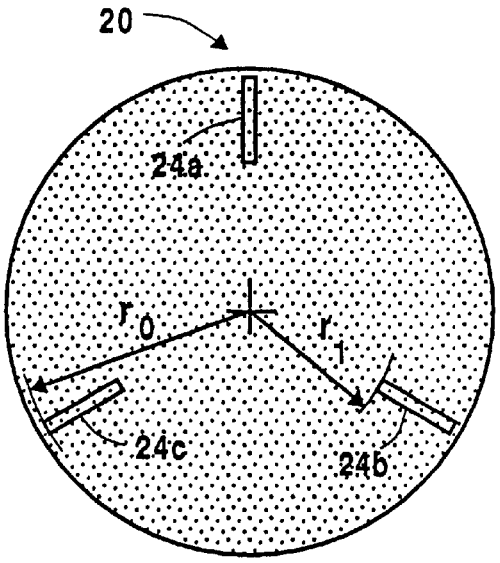
FIG. 3 is a cross-sectional view normal to the length of another embodiment of a graphite electrode having helical slots below the surface thereof.
Figure 4:
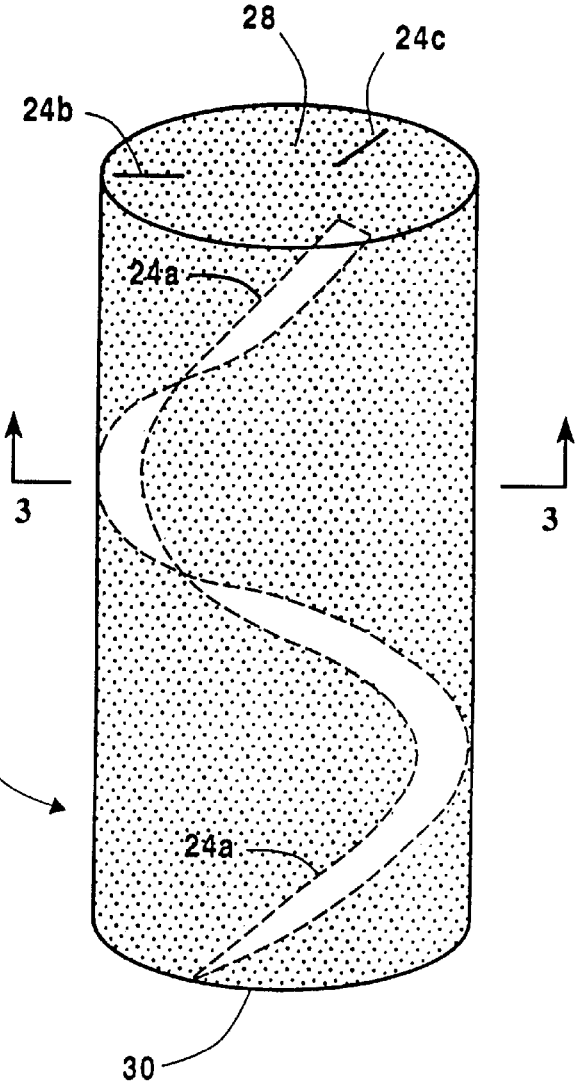
FIG. 4 is a perspective view of the graphite electrode of FIG. 3.

As shown in FIG. 2, cracks 23*a*, 23*b* and 23*c* may still occur, but are arrested by the slots 22*a*, 22*b*. Both vertical and horizontal cracks are more preferably reduced by another embodiment of the present invention is shown in FIGS. 3 and 4. In this embodiment, slots 24*a*, 24*b* and 24*c* are again are radially oriented and spaced around the circumference or periphery of graphite electrode 20. However, these slots differ from the previous embodiment in that the slots extend helically around the electrode and, in at least the upper portion of the electrode, the slots are not open to the electrode surface 26 but are fully contained below the surface.

It has been found that it is generally only lower in the furnace, where the electrode column is hot and oxidized, that the extremities of the slots need to be exposed. By leaving at least some finished electrode surface above the lower portion of the electrode without slot openings, the strength of the electrode against mechanical stresses is increased. As the external surface is oxidized away as the electrode descends through the furnace, the slots then become open to the surface.

Because it has been found that the stresses tend to generate horizontal cracks as well as vertical splits, the helical configuration as shown in FIGS. 3 and 4 provides both radial and axial stress relief. It is preferred that each helix should make at least one complete turn of the electrode in an axial length of about three meters.

For a 700 mm (28 in.) diameter electrode it is preferred that the inside radius of the slots ($r_i$, FIG. 3) should be about 175 mm (7 inches) while the outer radius ($r_o$, FIG. 3) should be about 300 mm (12 inches). Slot width again should be as thin as possible, for example, no greater than about 5 mm. Preferably the slots are no greater than about 3 mm wide.

To form the slots in the carbon body, the slots which are open to the surface, for example those shown in FIGS. 1 and 2, may be formed by cutting the slots in the electrode with a saw after forming and heat treating is completed. Alternatively, internal slots such as those shown in FIGS. 3 and 4 may be formed by placing a spacer configured to the shape of the slot in the opening of the extrusion die which forms the electrode. This spacer may be rotated during extrusion to form the helical configuration depicted in FIGS. 3 and 4. This spacer causes a split to the carbon during extrusion, which remains as a discontinuity after the carbon material is reformed around the body.

FIG. 5 shows a more preferred embodiment of the present invention wherein surface slot 22*e* and internal slot 24*d* are filled with a material different from the remaining electrode, preferably carbon-based cement. A useful carbonaceous cement is sold under the trademark Smartram, which is a carbonacious cement which contains intercalated natural graphite flake, and is available from UCAR Carbon Company, Inc. of Danbury, Conn.

FIG. 6 shows the effect of an electrode made in accordance with the present invention on arresting crack propagation and growth. Electrode 20 suspended in an electric arc steelmaking furnace fixture 38 has formed therein a helical slot 24*e* which is open to the surface 26 near lower end 30. Growth of either vertical or horizontal cracks 36*a*, 36*b* and 36*c* is prevented by the presence of the slot.

As a result of the present invention, the aforementioned objects are achieved namely, the production of a graphite electrode which is more resistant to splitting and breakage during extremes of thermal shock. In use, the electrodes are exposed to thermal shock and a crack may be initiated in the electrode and propagated along the length or circumference of the electrode. When the cracks meets a slot, substantial further growth of the crack is arrested. Graphite electrodes made in accordance with the present invention for use in electric arc steelmaking furnaces have been shown to have specially beneficial effects in prolonging electrode life.

While the present invention has been particularly described, in conjunction with a specific preferred embodiment, it is evident that many alternatives, modifications and variations will be apparent to those skilled in the art in light of the foregoing description. For example, there may be employed other slot configurations, such as horizontal slots, and slots of different cross-sections. It is therefore contemplated that the appended claims will embrace any such alternatives, modifications and variations as falling within the true scope and spirit of the present invention.

Thus, having described the invention, what is claimed is:

1. A carbon electrode comprising a carbon body having a cylindrical surface, a length, and a substantially solid radial cross-section normal to the length; and a discontinuous portion of said body comprising at least one slot extending helically within the radial cross-section along the length of said carbon body and not open to the cylindrical surface.

2. The carbon electrode of claim 1 wherein said discontinuous portion of said body comprises more than two slots.

3. The carbon electrode of claim 1 wherein said carbon body comprises graphite.

4. The carbon electrode of claim 1 wherein said carbon body comprises a graphite electrode having a threaded end and a consumable end opposite the threaded end.

5. A method of making a carbon electrode comprising the steps of:

(a) forming a carbon body having a cylindrical surface, a length, and a substantially solid radial cross-section normal to the length;

(b) heat treating said carbon body; and (c) forming in said carbon body a slot comprising a discontinuity within the radial cross-section of said carbon body extending helically along the length of said body and not open to the cylindrical surface.

* * * * *